US009727012B2

(12) United States Patent
Yang et al.

(10) Patent No.: US 9,727,012 B2
(45) Date of Patent: Aug. 8, 2017

(54) DUAL LAYER COMPOSITE COATING AND METHOD FOR MAKING SAME

(71) Applicant: XEROX CORPORATION, Norwalk, CT (US)

(72) Inventors: Suxia Yang, Mississauga (CA); Nan-Xing Hu, Oakville (CA); Qi Zhang, Milton (CA); Sandra J. Gardner, Oakville (CA); Edward G. Zwartz, Mississauga (CA); Guiqin Song, Milton (CA)

(73) Assignee: XEROX CORPORATION, Norwalk, CT (US)

( * ) Notice: Subject to any disclaimer, the term of this patent is extended or adjusted under 35 U.S.C. 154(b) by 306 days.

(21) Appl. No.: 14/260,911

(22) Filed: Apr. 24, 2014

(65) Prior Publication Data

US 2015/0309453 A1 Oct. 29, 2015

(51) Int. Cl.
*G03G 15/20* (2006.01)
*H01B 1/04* (2006.01)

(52) U.S. Cl.
CPC ..... *G03G 15/206* (2013.01); *G03G 15/2057* (2013.01); *H01B 1/04* (2013.01)

(58) Field of Classification Search
CPC ..... H01B 1/04
See application file for complete search history.

(56) References Cited

U.S. PATENT DOCUMENTS

| | | | | |
|---|---|---|---|---|
| 4,373,239 | A | 2/1983 | Henry et al. | |
| 5,501,881 | A | 3/1996 | Fuller et al. | |
| 5,512,409 | A | 4/1996 | Henry et al. | |
| 5,729,813 | A | 3/1998 | Eddy et al. | |
| 8,557,345 | B2 | 10/2013 | Qi et al. | |
| 2010/0189943 | A1 | 7/2010 | Qi et al. | |
| 2011/0103854 | A1* | 5/2011 | Gervasi | B82Y 30/00 399/333 |
| 2013/0017005 | A1* | 1/2013 | Zhang | G03G 15/2057 399/333 |
| 2014/0154512 | A1* | 6/2014 | Dooley | G03G 15/2057 428/411.1 |

OTHER PUBLICATIONS

Qi et al., "Graphene and Fluorpolymer Composite Fuser Coating", U.S. Appl. No. 14/044,352, filed Oct. 2, 2013, 33 pages.
Zhang et al., "Carbon Nanoparticle and Fluoropolymer Composite Fuser Coating," U.S. Appl. No. 14/260,802, filed Apr. 24, 2014, 49 pages.

* cited by examiner

*Primary Examiner* — William Young
(74) *Attorney, Agent, or Firm* — MH2 Technology Law Group LLP

(57) ABSTRACT

A member for a fuser assembly of a printer. The member may include a support body and a composite coating disposed on an outer surface of the support body. The composite coating may include a fluororesin and a nanocarbon material dispersed within the fluororesin. The nanocarbon material may be present in a higher concentration proximate the support body and a lower concentration proximate an outer surface of the composite coating. The lower concentration may be less than or equal to about 2 wt % of the nanocarbon material.

8 Claims, 4 Drawing Sheets

DUAL LAYER COMPOSITE COATING AND METHOD FOR MAKING SAME

TECHNICAL FIELD

The present teachings relate generally to electrophotographic printing devices and, more particularly, to a composite surface coating on a roller of a fuser assembly in an electrophotographic printing device and a method for making the composite surface coating.

BACKGROUND

In a typical electrophotographic printing apparatus, a light image of an original to be copied is recorded in the form of an electrostatic latent image upon a photosensitive member. The latent image is subsequently rendered visible by application of electroscopic thermoplastic resin particles, which are commonly referred to as toner. The visible toner image is then in a loose powdered form and is usually fused, using a fusing assembly, upon a support, which may be an intermediate member, or a print medium such as paper.

A conventional fusing assembly may include a fuser roller and a pressure roller, which may be configured to include a roll pair maintained in pressure contact or a belt member in pressure contact with a roll member. In a fusing process, heat may be applied by heating one or both of the fuser roller and the pressure roller.

The fuser roller may include a coating or "topcoat" to achieve target levels of toner release and thermal conductivity. Fluoropolymers, including polytetrafluoroethylene ("PTFE") and its copolymers such as perfluoroalkoxy ("PFA") resins, are often used in topcoats because they possess low surface energy to provide superior toner release. However, few materials have all desired properties. For example, some materials having low surface energy often have relatively low thermal conductivity, thus requiring more energy for fusing. Incorporating fillers into the topcoat to increase thermal conductivity has been attempted to remedy this problem, but this often results in poor toner release performance. Therefore, a topcoat having increased thermal conductivity while maintaining good toner release properties would be highly desired.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

A member for a fuser assembly of a printer is disclosed. The member may include a support body and a composite coating disposed on an outer surface of the support body. The composite coating may include a fluororesin and a nanocarbon material dispersed within the fluororesin. The nanocarbon material may be present in a higher concentration proximate the support body and a lower concentration proximate an outer surface of the composite coating. The lower concentration may be less than or equal to about 2 wt % of the nanocarbon material.

A fuser assembly of a printer is disclosed. The fuser assembly may include a member having a support body and a composite coating disposed on an outer surface of the support body. The composite coating may include a first layer including a first fluororesin and a first nanocarbon material present in an amount from about 2 wt % to about 50 wt %. The first layer may have a thickness from about 10 μm to about 50 μm. A second layer may be at least partially disposed on the first layer. The second layer may include a second fluororesin and a second nanocarbon material. The second nanocarbon material may be present in the second layer in an amount less than or equal to about 2 wt %. The second layer may have a thickness less than or equal to about 10 μm. The first nanocarbon material, the second nanocarbon material, or both may include carbon nanotubes, graphene, or a combination thereof.

A method of producing a fuser member is also disclosed. The method may include applying a first layer of a composite coating onto an outer surface of a fuser member substrate. The first layer of the composite coating may include a first fluororesin, a first nanocarbon material, a first dispersing agent, and a first solvent. The first layer of the composite coating may be at least partially dried after being applied. A second layer of the composite coating may be applied onto an outer surface of the first layer. The second layer may include a second fluororesin, a second nanocarbon material, a second dispersing agent, and a second solvent. The fuser member substrate, the first layer, and the second layer may be heated to a temperature ranging from about 285° C. to about 380° C. to form a dual-layer composite coating on the fuser member substrate.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the figures have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same, similar, or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc. It will be understood that the structures depicted in the figures may include additional features not depicted for simplicity, while depicted structures may be removed or modified.

Figure 1:
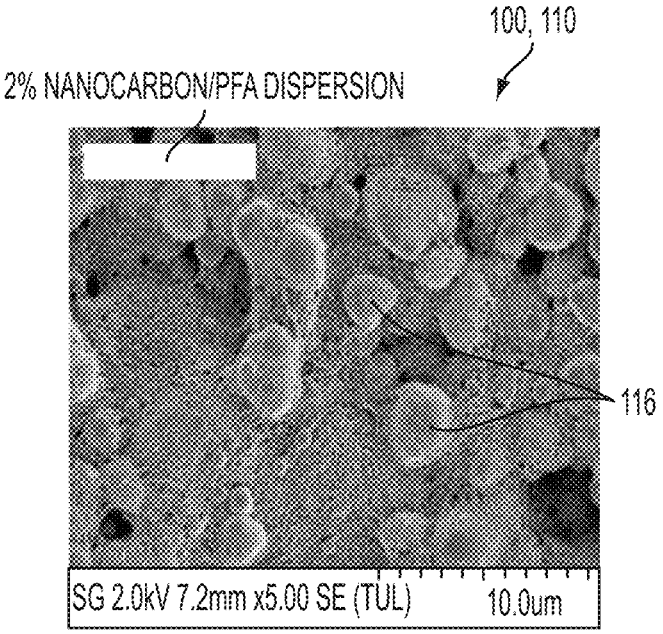
FIG. 1 depicts a photograph taken with a scanning electron microscope ("SEM") of a dispersion of a first or lower layer of an illustrative coating to be applied on a roller of a fuser assembly, according to one or more embodiments disclosed.

FIG. 1 depicts a photograph taken with a scanning electron microscope ("SEM") of a dispersion of a first or lower layer 110 of an illustrative coating 100 to be applied on a roller of a fuser assembly, according to one or more embodiments disclosed. The coating composition to be applied to form the first layer 110 may be a liquid dispersion made up of one or more materials. In at least one embodiment, the liquid dispersion may include a nanocarbon material, a fluororesin, a dispersing agent, and a solvent. Further, the liquid dispersion may also include other materials, such as a thickening agent, to assist coating quality.

The first layer 110 may include a nanocarbon material (not clearly visible in FIG. 1) such as carbon nanotubes ("CNTs"), graphene, or a combination thereof. When applied to the roller (i.e., prior to heating) the nanocarbon material may be present in the first layer 110 in an amount ranging from about 0.1 wt % to about 5 wt %, about 0.3 wt % to about 3 wt %, or about 0.5 wt % to about 1 wt %.

The first layer 110 may also include a fluororesin 116. The fluororesin 116 may be or include a fluoropolymer, a perfluoroalkoxy polymer resin ("PFA"), a polytetrafluoroethylene ("PTFE," e.g., TEFLON®), poly(tetrafluoroethylene-co-perfluoropropyl vinyl ether), a fluorinated ethylenepropylene copolymer ("FEP"), or a combination thereof. When applied to the roller (i.e., prior to heating) the fluororesin 116 may be present in the first layer 110 in an amount ranging from about 10 wt % to about 60 wt %, about 20 wt % to about 50 wt %, or about 30 wt % to about 40 wt %. Prior to heating, the fluororesin 116 may have an average particle size (e.g., cross-sectional length or diameter) from about 1 μm to about 20 μm, about 3 μm to about 15 μm, or about 5 μm to about 10 μm. Particles of this size may reduce cracking in the first layer 110.

The first layer 110 may also include a dispersing agent (not clearly visible in FIG. 1) to aid dispersion of the nanocarbon material for uniform coating. The dispersing agent may be or include, but is not limited to, a polyacrylic acid, a sulfonated fluoropolymer, or a combination thereof. When applied to the roller (i.e., prior to heating) the dispersing agent may be present in the first layer 110 in an amount ranging from about 0.01 wt % to about 4 wt %, about 0.05 wt % to about 2 wt %, or about 0.20 wt % to about 1 wt %.

The first layer 110 may also include a solvent. The solvent is used to support the composite coating. The solvent may be or include water, acetone, isopropanol, N-methyl-2-pyrrolidone, methylethylketone, cyclohexanone, an ester alcohol, or a combination thereof. When applied to the roller (i.e., prior to heating) the solvent may be present in the first layer 110 in an amount ranging from about 30 wt % to about 80 wt %, about 30 wt % to about 55 wt %, or about 55 wt % to about 80 wt %.

The first layer 110 may further include a thickening material (not clearly visible in FIG. 1) to achieve coating performance. The thickening material may be or include a small molecule, a polymer, or a combination thereof. For example, the thickening material may be or include an ester alcohol such as TEXANOL®, a polymer such as a polyvinyl butyral, poly(alkylene carbonates) and the like, or a combination thereof. When applied to the roller (i.e., prior to heating) the thickening material may be present in the first layer 110 in an amount ranging from about 0.1 wt % to about 10 wt %, about 0.5 wt % to about 5 wt %, or about 1 wt % to about 3 wt %.

To achieve a substantially uniform distribution of the nanocarbon material in the first layer 110, a powder containing the nanocarbon material may be dispersed in an isopropanol solution ("IPA") containing a dispersing agent such as a sulfonated fluoropolymer (e.g., NAFION®) by a sonification or ultrasonification process to form a first mixture. A powder containing the fluororesin 116 (e.g., PTFE or PFA) may also be dispersed in an isopropanol solution to form a second mixture. The first and second mixtures may be combined and mixed by further sonification to form a third mixture. The dispersion quality may be seen in FIG. 1. The nanocarbon material and fluororesin 116 may be associated together substantially uniformly forming a substantially homogeneous dispersion.

Figure 2:
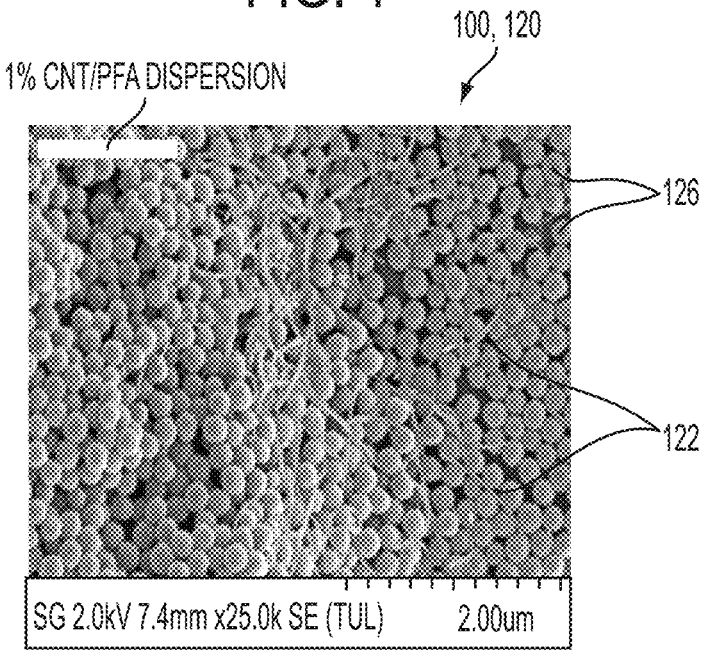
FIG. 2 depicts a photograph taken with the scanning electron microscope of a dispersion of a second or upper layer of the illustrative coating to be applied over the first layer on the roller of the fuser assembly, according to one or more embodiments disclosed.

FIG. 2 depicts a photograph taken with the scanning electron microscope ("SEM") of a dispersion of a second or upper layer 120 of the illustrative coating 100 to be applied over the first layer 110 (shown in FIG. 1) on the roller of the fuser assembly, according to one or more embodiments disclosed. The coating composition to be applied to form the second layer 120 may be a liquid dispersion (e.g., an aqueous dispersion) made up of one or more materials. More particularly, the liquid dispersion may include a nanocarbon material, a fluororesin, a dispersing agent, and a solvent.

The second layer 120 may include a nanocarbon material 122 similar to those described above with respect to the first layer 110. However, the second layer 120 may have a lesser loading (e.g., by wt %) of the nanocarbon material 122 than the first layer 110. In at least one embodiment, when applied to the roller (i.e., prior to heating) the nanocarbon material 122 may be present in the second layer 120 in an amount less than or equal to about 2 wt %. For example, the nanocarbon material 122 may be present in the second layer 120 in an amount from about 0 wt % to about 3 wt %, about 0.1 wt % to about 2 wt %, or about 0.5 wt % to about 1 wt %. Thus, before and/or after heating, a concentration of the nanocarbon material 122 in the coating 100 may be a gradient with a higher concentration of the nanocarbon material present proximate the base of the coating 100 (e.g., proximate an outer surface of a roller) and a lower concentration of the nanocarbon material 122 proximate the outer surface of the coating 100.

The second layer 120 may also include a fluororesin 126. For example, the fluororesin 126 may be or include a fluoropolymer, perfluoroalkoxy ("PFA," e.g., Dupont PFA TE7224), polytetrafluoroethylene ("PTFE," e.g., TEFLON®), poly(tetrafluoroethylene-co-perfluoropropyl vinyl ether), fluorinated ethylenepropylene copolymer ("FEP"), or a combination thereof. The fluororesin 126 may be similar to the fluororesin 116 in the first layer 110. Prior to heating, the fluororesin 126 may have an average particle size (e.g., cross-sectional length or diameter) ranging from about 10 nm to about 1000 nm, about 50 nm to about 500 nm, or about 100 nm to about 300 nm. Particles of this size may help produce a uniform, thin second layer 120. When applied to the roller (i.e., prior to heating) the fluororesin 126 may be present in the second layer 120 in an amount ranging from about 1 wt % to about 20 wt %, about 2 wt % to about 15 wt %, or about 3 wt % to about 10 wt %.

The second layer 120 may also include a dispersing agent and/or a solvent. The dispersing agent may be or include a polyacrylic acid, a sulfonated fluoropolymer, or a combination thereof. When applied to the roller (i.e., prior to heating) the dispersing agent may be present in the second layer 120 in an amount ranging from about 0 wt % to about 3 wt %, about 0.5 wt % to about 2.5 wt %, or about 1 wt % to about 2 wt %. The solvent may be or include water, acetone, isopropanol, N-methyl-2-pyrrolidone, methylethylketone, cyclohexanone, an ester alcohol, or a combination thereof. When applied to the roller (i.e., prior to heating) the solvent may be present in the second layer 120 in an amount ranging from about 50 wt % to about 95 wt %, about 60 wt % to about 90 wt %, or about 70 wt % to about 85 wt %.

To form the second layer 120, a powder containing the nanocarbon material 122 may be dispersed into a water solution of the polymer (e.g., poly(acrylic acid)) by a sonification or ultrasonification process to form a first mixture. The first mixture may be or include an exfoliated nanocarbon material/water dispersion. The fluororesin 126 (e.g., PTFE or PFA) dispersion may be combined with the first mixture to form a second mixture. The second mixture may be or include a homogeneous coating dispersion, as shown in FIG. 2.

Figure 4:
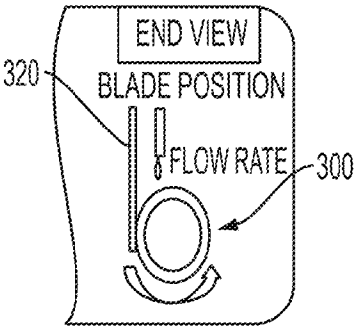
FIGS. 3 and 4 depict schematic side and end views, respectively, of the first or lower layer of the coating being applied to an outer surface of a roller of a fuser assembly, according to one or more embodiments disclosed.
Figure 3:
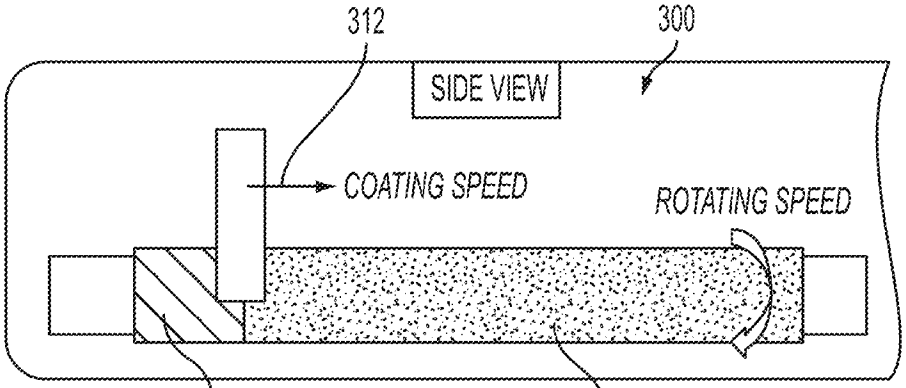

FIGS. 3-6 illustrate the application of the first and second layers 110, 120 of the coating 100 onto a roller 300 of a fusion assembly of a printer. More particularly, FIGS. 3 and 4 depict schematic side and end views, respectively, of the first or lower layer 110 of the coating 100 being applied to an outer (radial) surface 310 of a roller 300 of a fuser assembly, according to one or more embodiments disclosed.

The outer surface 310 of the roller 300 may include a primed silicone substrate. The roller 300 may be rotating about a central longitudinal axis at a rate ranging from about 50 RPM to about 200 RPM, about 75 RPM to about 175 RPM, or about 100 RPM to about 150 RPM.

The first layer 110 may be applied onto the outer surface 310 of the roller 300 by flow coating. The (axial) coating speed of the first layer 110 may range from about 0.5 mm/s to about 6 mm/s, about 1 mm/s to about 4 mm/s, or about 1.5 mm/s to about 3 mm/s. The direction of the axial coating speed is shown by the arrow 312. The flow rate of the first layer 110 onto the outer surface 310 of the roller 300 may be from about 1 ml/min to about 10 ml/min, about 2 ml/min to about 8 ml/min, or about 3 ml/min to about 6 ml/min.

A position of a blade 320 may be from about −4 mm to about 0 mm, about −3 mm to about −0.25 mm, or about −2 mm to about −0.5 mm with respect to the surface of the roller 300. This may enable the blade 320 to have solid contact with the roller 300 without too much pressure. Once the first layer 110 has been applied to the outer surface 310 of the roller 300, the roller 300 may at least partially dry (e.g., air-dry).

Figure 6:
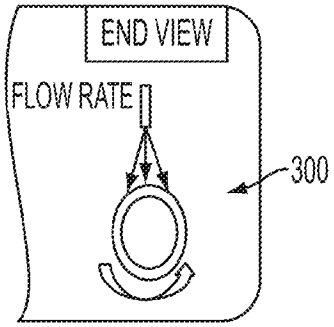
FIGS. 5 and 6 depict schematic side and end views, respectively, of the second or upper layer of the coating being applied over the first or lower layer of the coating on the roller of the fuser assembly, according to one or more embodiments disclosed.
Figure 5:
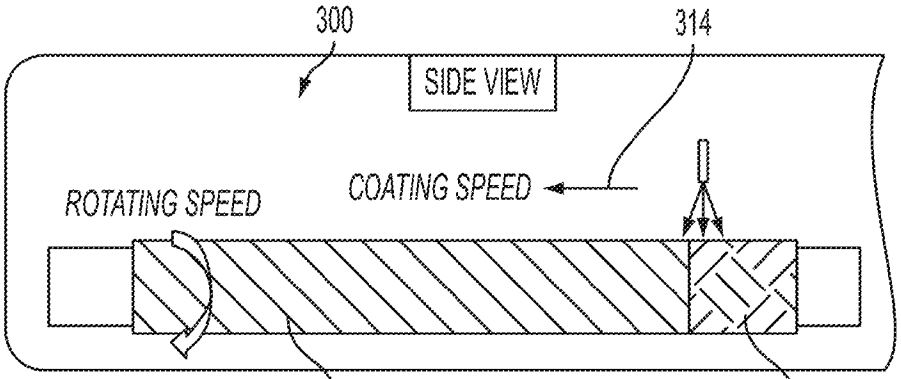

FIGS. 5 and 6 depict schematic side and end views, respectively, of the second or upper layer 120 of the coating 100 being applied on or over the first or lower layer 110 of the coating 100 on the roller 300 of the fuser assembly, according to one or more embodiments disclosed. Once the first layer 110 has at least partially dried on the outer surface 310 of the roller 300, the second layer 120 may be applied at least partially on or over the first layer 110. The roller 300 may rotate at substantially the same speed disclosed above. For example, the roller 300 may be rotating from about 50 RPM to about 200 RPM, about 75 RPM to about 175 RPM, or about 100 RPM to about 150 RPM.

The (axial) coating speed of the second layer 120 may be greater than the (axial) coating speed of the first layer 110. The axial coating speed may range from about 1 mm/s to about 20 mm/s, about 3 mm/s to about 15 mm/s, or about 5 mm/s to about 10 mm/s. The direction of the axial coating speed is shown by the arrow 314. The axial coating speed refers to the axial speed at which the first and/or second layers 110, 120 are applied along (at least a portion of) the length of the roller 300 (i.e., parallel to the longitudinal axis of the roller 300).

The flow rate of the second layer 120 onto the first layer 110 may be greater than the flow rate at which the first layer 110 is applied to the outer surface 310 of the roller 300. In at least one embodiment, the flow rate of the second layer 120 may be from about 1 ml/min to about 12 ml/min, about 2 ml/min to about 10 ml/min, or about 4 ml/min to about 8 ml/min. Prior to being sprayed onto the first layer 110 as the second layer 120, the atomization pressure of the fifth mixture (described above) may range from about 5 pounds per square inch ("PSI") to about 50 PSI, about 10 PSI to about 40 PSI, or about 15 PSI to about 30 PSI.

Once applied onto the first layer 110 and/or the roller 300, the second layer 120 may at least partially dry (e.g., air-dry). Once the second layer 120 has at least partially dried, the roller 300 may be heated (e.g., baked) to a first temperature to remove any residual solvent. In at least one embodiment, the first temperature may be from about 80° C. to about 200° C., about 80° C. to about 150° C., or about 80° C. to about 125° C., and the roller 300 may be heated to the first temperature from about 15 minutes to about 4 hours, about 30 minutes to about 2 hours, or about 45 minutes to about 1.5 hours.

Once heated to the first temperature, the roller 300 may be heated (e.g., baked) to a second temperature above the melting point of the fluororesins 116, 126 (e.g., PTFE or PFA) to cure. In at least one embodiment, the second temperature may be from about 200° C. to about 400° C., about 250° C. to about 380° C., or about 285° C. to about 350° C., and the roller 300 may be heated to the second temperature from about 2 minutes to about 1 hour, about 5 minutes to about 30 minutes, or about 10 minutes to about 20 minutes.

During the heating at the first and/or second temperature, the solvent used for the first layer and second layer coating may be removed (e.g., by evaporation or decomposition). Further, the one or more dispersing agents (e.g., polyacrylic acid and/or perfluorosulfonic acid) initially present in the coating 100 when the coating 100 is applied may change chemical structure or be removed via decomposition, and thus, may no longer be present in the coating 100 after heating. In addition, the heating may cause the fluororesin particles 116, 126 in the coating 100 to melt to form a homogeneous polymer layer during the heating.

Once heating is complete, a concentration of the nanocarbon material 122 in the coating 100 may be a gradient with a higher concentration of the nanocarbon material present proximate the base of the coating 100 (e.g., proximate an outer surface of a roller) and a lower concentration of the nanocarbon material 122 proximate the outer surface of the coating 100.

In at least one embodiment, after heating, the first layer 110 may include a nanocarbon material present in an amount from about 2 wt % to about 50 wt %, about 5 wt % to about 40 wt %, or about 10 wt % to about 30 wt %. After heating, the second layer may include a nanocarbon material, present in an amount less than or equal to about 5 wt %, less than or equal to about 2 wt %, or less than or equal to about 1 wt %. Further, a ratio of an average thermal conductivity of the dual-layer composite coating 100 including the first layer 110 and the second layer 120 to an average thermal conductivity of the fluororesins 116, 126 may be from about 1:1 to about 5:1 or about 1.5:1 to about 3:1. The coating 100 may have a surface energy of from about 5 $mN/m^2$ to about 25 $mN/m^2$ or about 10 to about 20 $mN/m^2$.

Once heating is complete, the first layer 110 may have a thickness or depth ranging from about 5 μm to about 20 μm, about 10 μm to about 50 μm, or about 15 μm to about 30 μm, and the second layer 120 may have an average thickness or depth less than or equal to about 10 μm, less than or equal to about 5 μm, or less than or equal to about 2 μm.

Flow coating the first layer 110 with a higher loading of nanocarbon material may raise the thermal conductivity for the coating 100, and spraying the second layer 120 having the lesser loading of nanocarbon material 122 may improve toner release. This may increase printer speed and lower the minimal fusing temperature while maintaining good image quality. This may also decouple the requirement for a single layer to provide high thermal conductivity and good toner release.

Figure 7:
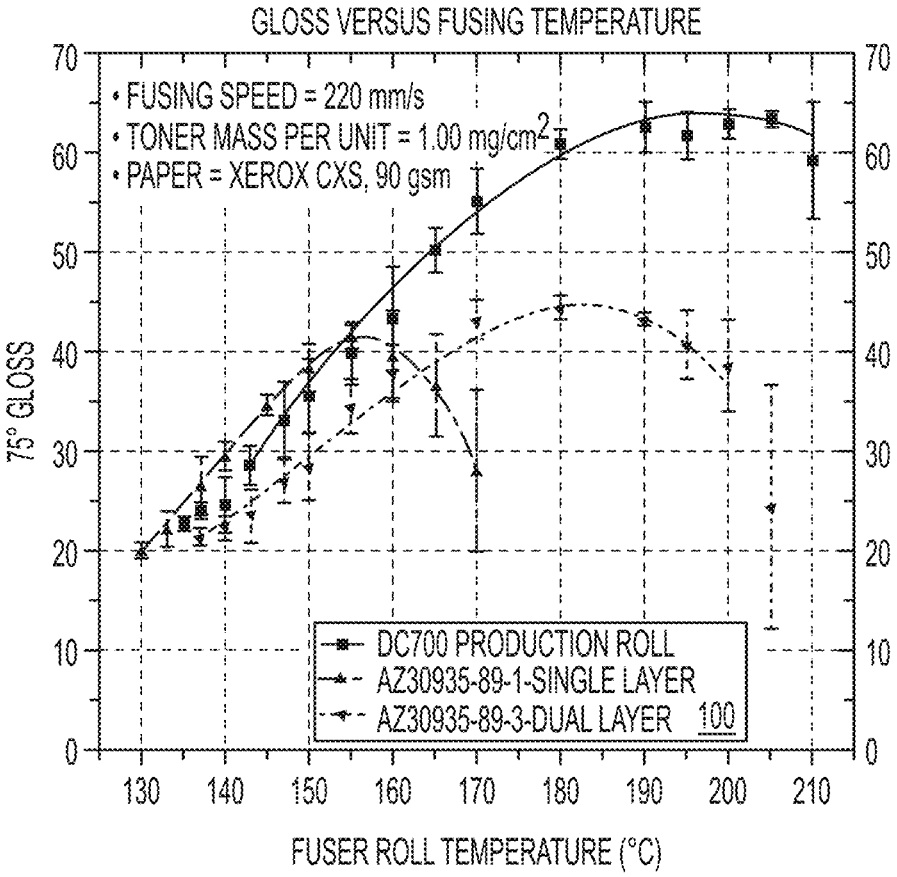
FIG. 7 depicts a graph showing "Gloss versus Fusing Temperature" for a conventional single layer coating and for the dual layer coating described in this disclosure, according to one or more embodiments.

FIG. 7 depicts a graph showing "Gloss versus Fusing Temperature" for a conventional single layer coating and for the dual layer coating described in this disclosure, according to one or more embodiments. As may be seen, the uniform and homogeneous dual layer coating 100 disclosed herein exhibits improved fusing performance for emulsion aggregation toners. The hot offset temperature increased from about 165° C. to about 195° C. from the conventional single layer coating to the dual layer coating 100. Thus, a wider fusing latitude may be achieved with the dual layer process.

Figure 8:
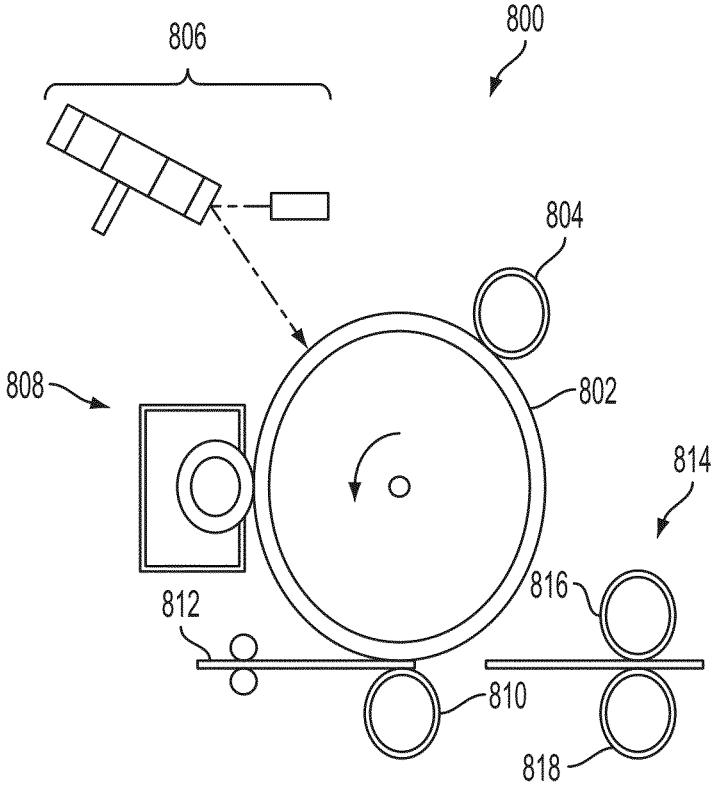
FIG. 8 depicts a schematic view of an illustrative printer including the fuser assembly with the dual layer coating, according to one or more embodiments.

FIG. 8 depicts a schematic view of an illustrative printer 800, according to one or more embodiments. The printer 800 may be a xerographic printer and may include an electrophotographic photoreceptor 802 and a charging station 804 for uniformly charging the electrophotographic photoreceptor 802. The electrophotographic photoreceptor 802 may be a drum photoreceptor as shown in FIG. 8 or a belt photoreceptor (not shown). The printer 800 may also include an imaging station 806 where an original document (not shown) may be exposed to a light source (also not shown) for forming a latent image on the electrophotographic photoreceptor 802. The printer 800 may further include a development subsystem 808 for converting the latent image to a visible image on the electrophotographic photoreceptor 802 and a transfer subsystem 810 for transferring the visible image onto a media 812 (e.g., paper). The printer 800 may also include a fuser assembly 814 (e.g., an oil-less fuser assembly) for fixing the visible image onto the media 812. The fuser assembly 814 may include one or more of a first or fuser roller 816, a second or pressure roller 818, oiling subsystems (not shown), and a cleaning web (not shown). The first and/or second roller 816, 818 may be or include a hollow, cylindrical body.

The following examples describe illustrative methods for preparing single layer and dual layer coatings for fuser rollers. The examples are not intended to be limiting.

Example 1

Single Layer Coating 0.4 grams of multi-walled carbon nanotubes ("CNT") were dispersed in 40 grams of an isopropanol ("IPA") solution containing 3.2 grams of a NAFION® 117 solution (Sigma, 5 wt % in mixed $H_2O$/IPA). This CNT/IPA dispersion was sonicated for 3 hours with a 60% output of an ultrasonic processor. About 3 grams of a PFA powder (MP320, available from E. I. du Pont de Nemours, Inc.) was dispersed with 6 grams of the CNT/IPA dispersion and sonicated multiple times to form a 2% CNT/PFA composite dispersion. 0.15 grams of TEXANOL® (an ester alcohol, 2,2,4-Trimethyl-1,3-pentanediol Monoisobutyrate Sigma-Aldrich) was added to the composite dispersion to form a homogeneous coating dispersion. This may be seen in FIG. 1.

The homogeneous coating dispersion was applied onto a fuser roller (e.g., fuser roller 816 in FIG. 8) by flow coating at a flow rate of 2-3 ml/min with a coating speed of about 2 mm/s to form a (single layer) coating on the fuser roller. The fuser roller included a metal core coated with a silicone layer and a fluoropolymer primer. The fuser roller was heated (e.g., baked) for 60 minutes at 100° C., followed by further baking for 15 minutes at 330° C., to form a fuser roller with a 2% CNT/PFA coating layer (e.g., first layer). The coating layer was approximately 20-30 μm thick.

Example 2

The 2% CNT/PFA dispersion prepared in Example 1 was applied onto a fuser roller (e.g., fuser roller 816 in FIG. 8) by flow coating at the flow rate of 2~3 ml/min with the coating speed of 2 mm/s to form a first (e.g., bottom) coating layer. A second coating was prepared by spray coating a diluted aqueous PFA emulsion (5 wt % DUPONT® TE7224) on the first coating layer with a heating element inserted inside the fuser roller (e.g., about 50° C.) at a flow rate of 3 ml/min with a coating speed of 7 mm/s. The fuser roller was baked for 60 minutes at 100° C., followed by further baking for 15 minutes at 330° C. to form a fuser roller with a dual-layer CNT/PFA composite coating. The dual-layer coating was approximately 20~30 μm thick.

Example 3

A dispersion of 1% Graphene and 0.4% NAFION®/IPA was prepared by dispersing about 0.4 grams of graphene powder (STREM 06-0210) in 40 grams of an isopropanol ("IPA") solution containing 3.2 grams of NAFION® 117 solution (Sigma, 5 wt % in mixed $H_2O$/IPA). The dispersion was sonicated for 3 hours with a 60% output of an ultrasonic processor. About 33 wt % of a PFA powder (10 grams) (MP320, available from E. I. du Pont de Nemours, Inc.) was added with 20 grams of the (1% Graphene/0.4% NAFION®/IPA) dispersion and sonicated multiple times to form a 2% Graphene/PFA composite dispersion. 0.5 grams of TEXANOL® (sigma 538221) was added to the composite dispersion with rolling to form a homogeneous coating dispersion. A first (e.g., bottom) coating layer was produced by flow coating the composite dispersion onto the primed silicone fuser roller using the coating method described in Example 1. A second (e.g., top) coating dispersion was prepared by mixing an aqueous CNT dispersion with an aqueous PFA emulsion (DUPONT® TE7224) to form a 1% CNT/PFA dispersion containing 10 percent of PFA. The dispersion quality was confirmed by SEM imaging, shown in FIG. 2. The dispersion was sprayed on the first (e.g., bottom) coating layer with a heating element inserted inside the fuser roller (e.g., about 50° C.) at a flow rate of 3 ml/min with a coating speed of 7 mm/s to form the second (e.g., top) coating layer. The fuser roller coated with dual-layer Graphene/PFA coating was then fabricated using the same baking process as in Example 1.

Example 4

A composite coating dispersion containing 1% graphene and 1% CNT was prepared by mixing 10 grams of PFA powder with 10 grams of a 1% CNT/IPA dispersion and 10 g of a 1% graphene/IPA dispersion. This composite dispersion was sonicated for 60 minutes with a 60% output. 0.5 grams of TEXANOL® (sigma 538221) was added to the composite dispersion to form a homogeneous coating dispersion. The first (e.g., bottom) layer was prepared by flow coating the coating dispersion onto a primed fuser roller (e.g., fuser roller 816 in FIG. 8) using the same coating conditions in the above examples. The second (e.g., top) coating layer was prepared by spray coating a diluted aqueous PFA emulsion (5 wt % DUPONT® TE7224) on the first coating layer with the same process conditions. The dual-layer 1% CNT/1% graphene/PFA composite coating was produced by the same baking processing the above examples.

Evaluation of Fusing Performance

The fuser rollers obtained from Example 1 and Example 2 were tested with a fusing fixture using a commercial XEROX® DC700 fuser as control. The control fuser roller has a metal core and a silicone layer similar to the experimental fuser rollers (in Examples 1 and 2), but applies a pure PFA surface layer. Unfused images of DC700 toner were generated and sent through the fixture with the experimental fuser rollers. The fuser roller temperature was varied from cold offset (loss of adhesion to the paper) to hot offset (toner adheres to the fuser roller) for gloss and crease measurements on the fused image samples. A BYK-GARDNER® 75° gloss meter was used to measure fused image gloss as a function of fuser roller temperature. As shown in FIG. 7, the fuser roller with the single layer coating in Example 1 exhibited a hot offset temperature around 170° C., while the fuser roller with the dual-layer coating in Example 2 had an offset temperature around 205° C.—close to the control fuser roller. The increased hot offset temperature of the fuser roller with the dual-layer coating indicates that the fuser roller with the dual-layer coating has a widened fusing latitude as compared to the fuser roller with the single layer coating. In addition, a minimal fusing temperature ("MFT") was determined with crease area measurement on the fused image using an internal image analysis system. The fuser roller with the dual-layer coating showed about 10° C. reduction in MFT as compared to a DC700 fuser roller with the single layer PFA coating, demonstrating that the dual layer coating possessed significantly increased thermal conductivity with respect to pure PFA coating.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" may include any and all sub-ranges between (and including) the minimum value of zero and the maximum value of 10, that is, any and all sub-ranges having a minimum value of equal to or greater than zero and a maximum value of equal to or less than 10, e.g., 1 to 5.

While the present teachings have been illustrated with respect to one or more implementations, alterations and/or modifications may be made to the illustrated examples without departing from the spirit and scope of the appended claims. For example, it may be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It may be appreciated that structural components and/or processing stages may be added, or existing structural components and/or processing stages may be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items may be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, the terms "exemplary" or "illustrative" indicate the description is used as an example, rather than implying that it is an ideal. Other embodiments of the present teachings may be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

What is claimed is:

1. A fuser assembly of a printer, comprising:

a member having a support body; and a composite coating disposed on an outer surface of the support body, the composite coating comprising:

a first layer comprising:

a first fluororesin present in an amount from about 10 wt % to about 60 wt %;

a first nanocarbon material present in an amount from about 2 wt % to about 50 wt %;

a first dispersing agent present in an amount from about 0.20 wt % to about 1 wt %, wherein the first dispersing agent changes chemical structure in response to the composite coating being heated, and wherein the first layer has a thickness from about 10 μm to about 50 μm; and a second layer at least partially disposed on the first layer, the second layer comprising:

a second fluororesin present in an amount from about 1 wt % to about 20 wt %, wherein the first fluororesin and the second fluororesin form a homogeneous polymer layer;

a second nanocarbon material present in an amount that is greater than 0 wt % and less than or equal to about 2 wt %, wherein the second layer has a thickness that is greater than 0 μm and less than or equal to about 10 μm, and wherein the first nanocarbon material, the second nanocarbon material, or both comprises carbon nanotubes, graphene, or a combination thereof; and a second dispersing agent present in an amount from about 1 wt % to about 2 wt % wherein a concentration of the first and second nanocarbon materials comprises a gradient in the composite coating with a higher concentration proximate to the support body and a lower concentration proximate to an outer surface of the composite coating.

2. The fuser assembly of claim 1, wherein the first fluororesin, the second fluororesin, or both is selected from the group consisting of polytetrafluoroethylene (PTFE), perfluoroalkoxy polymer resin (PFA), poly(tetrafluoroethylene-co-perfluoropropyl vinyl ether), fluorinated ethylenepropylene copolymer (FEP), and a combination thereof.

3. The fuser assembly of claim 1, wherein the second nanocarbon material is present in the second layer in an amount greater than zero wt % and less than or equal to about 1 wt %, and wherein the second layer has a thickness less than or equal to about 5 μm.

4. The fuser assembly of claim 1, wherein the composite coating comprises an average thermal conductivity that is from about 1.5 to about 3 times a thermal conductivity of the fluororesin.

5. The fuser assembly of claim 1, wherein the composite coating comprises a surface energy of from about 15 $mN/m^2$ to about 20 $mN/m^2$.

6. The fuser assembly of claim 1, wherein:

the first fluororesin comprises a perfluoroalkoxy polymer resin;

the first nanocarbon material comprises multi-walled carbon nanotubes;

the first dispersing agent comprises a sulfonated fluoropolymer; and the second fluororesin comprises an aqueous perfluoroalkoxy emulsion.

7. The fuser assembly of claim 1, wherein:

the first fluororesin comprises a perfluoroalkoxy polymer resin;

the first nanocarbon material comprises a graphene powder;

the first dispersing agent comprises a sulfonated fluoropolymer;

the second fluororesin comprises an aqueous perfluoroalkoxy emulsion.

8. The fuser assembly of claim 1, wherein the first nanocarbon material is initially present in the composite coating in an amount from about 0.1 wt % to about 5 wt % prior to the composite coating being heated, and wherein the second nanocarbon material is initially present in the composite coating in an amount from about 0.1 wt % to about 2 wt % prior to the composite coating being heated.

* * * * *